United States Patent [19]

Taylor et al.

[11] 3,977,671

[45] Aug. 31, 1976

[54] METHOD AND APPARATUS FOR FORMING A PLURALITY OF EVEN-EDGED PILES OF FLEXIBLE SHEETS

[75] Inventors: Ruel E. Taylor, West Buxton; Alston R. Wormwood, Gorham, both of Maine

[73] Assignee: Ruel E. Taylor, Inc., Gorham, Maine

[22] Filed: Sept. 19, 1975

[21] Appl. No.: 615,064

Related U.S. Application Data

[63] Continuation-in-part of Ser. No. 403,055, Oct. 3, 1973, Pat. No. 3,923,299.

[52] U.S. Cl. ..... 271/221; 83/105; 93/93 R; 214/6 S; 271/64

[51] Int. Cl.[2] ..... B65H 31/38; B65H 31/24

[58] Field of Search ..... 271/221, 222, 210, 240, 271/223, 64, 9, 248, 250, 251; 214/6 S; 83/105, 94, 788, 820; 93/93 R; 198/30, 31 AA, 181, 195

[56] References Cited

UNITED STATES PATENTS 3,083,014 3/1963 Howdle et al. ..... 271/221 X 3,713,651 1/1973 Abler et al. ..... 271/221

*Primary Examiner*—Evon C. Blunk
*Assistant Examiner*—Bruce H. Stoner, Jr.
*Attorney, Agent, or Firm*—Charles E. Pfund

[57] ABSTRACT

In a layboy arrangement to which are delivered simultaneously side-by-side sheets to form a plurality of piles of such sheets edge joggers are provided to align the outside edges of the piles of sheets and a mechanism is provided which operates to align the adjacent edges of adjacent piles. The mechanism is in the form of a chain guide bar or plate around which an endless link chain is driven and from which project a set of overlapping leaves. The apparatus is mounted such that the overlapping leaves on the bottom edge of the chain bar project between the piles of sheets. The chain is driven to move the leaves around the periphery of the chain bar such that an active surface moves in the direction of travel between the sheets as they are edge jogged into their even edge piles on opposite sides of the overlapping leaves of the guide mechanism.

12 Claims, 5 Drawing Figures

2
43
31
43
42'
45
41
34
44
42
40
2

33
32
31
36
39
39
34
35
30
50
48
49
26"
26'
41
42
27
47
46
25
40
45
37
26
17

METHOD AND APPARATUS FOR FORMING A PLURALITY OF EVEN-EDGED PILES OF FLEXIBLE SHEETS

CROSS-REFERENCE TO RELATED APPLICATION

This application is a continuation-in-part of applicants' copending application Ser. No. 403,055, filed Oct. 3, 1973, now U.S. Pat. No. 3,923,299.

BACKGROUND OF THE INVENTION

The background of the present invention is generally the same as that described in the above-identified copending application and pertains to the continuous cutting of large rolls of paper to form sheets of predetermined size which are piled into large piles suitable for direct use by the printing industry. In the foregoing application improved jogger method and apparatus is disclosed and claimed which permits piles to be made which are of uniformly high quality as respects stacking and edge alignment such that they can be directly sold and used by the printing industry without being repiled. The expense and labor saved by achieving a finishing product of cut sheets which is directly saleable is substantial and, of course, the advantages thereof are self-evident.

Since the size of the sheet which the customer desires is dictated by his own needs, a sheeting operation may not be as efficient or economical as desired where smaller size sheets are desired to be obtained from relatively wide rolls of paper. Of course, in the sheeting operation the length of the sheet in the direction of travel thereof through the sheeter can be controlled within wide limits by the rotational speed of the transverse blade which separates the continuous web of paper unwound from the supply roll into the desired length sheets each time it contacts the bed knife with the paper web therebetween. The maximum tonnage through-put through the machine of course, occurs when maximum linear speed is run with maximum width rolls (sometimes with two or more thicknesses of sheets cut at the same time by feeding multilayer webs from plural supply rolls) and the use of wide supply rolls is not consistent with cutting sheets of width smaller than the width of the supply roll. Thus as the web travels through the machine it can be edge trimmed to the desired width but if smaller sheets are desired the width of the web is subdivided by slitting the web longitudinally as it passes through the machine to produce two or more sheets which pass edge-to-edge beyond the bed knife through the machine to be delivered to the layboy. Where two or more such sheets are delivered to a layboy simultaneously it has heretofore been difficult if not impossible to obtain quality piling such that the plural stacks of edge adjacent sheets which are piled in the layboy by slitting the on-coming web one or more times cannot be directly sold but must be repiled or trimmed before being delivered to the printing industry.

SUMMARY OF THE INVENTION

The present invention provides method and apparatus whereby plural simultaneously formed edge adjacent piles in a layboy can be piled uniformly and with the requisite edge alignment such that the piles can be sold directly without edge trimming or repiling to achieve the desired quality pile. For this purpose the present invention utilizes edge-jogging mechanisms in the layboy preferably of the type disclosed and claimed in applicants' copending application and between the adjacent edges of the plural simultaneously delivered sheets introduces a moving guide member which achieves edge alignment in combination with the outboard jogger mechanism such that all piles formed (two or more) are finished with the requisite precision edge alignment. This is achieved without introducing any requirements for deflecting the paper or otherwise slowing its arrival speed and thus reducing linear speed throughput through the machine and at the same time provides a moving active surface for the jogging reaction on the inner edges such that the edge of the sheets are not defaced or deformed in a manner which would make them unacceptable for quality printing. For this purpose a set of moving over-lapping thin leaf members is projected down between the adjacent edges of the piles of paper as they are formed to move with the arriving sheet with entry and exit of the overlapping leaves arranged by virtue of the nested structure thereof and their path of travel into a position between the forming piles of sheets such that edge damage to the sheets is substantially completely absent.

DESCRIPTION OF THE PREFERRED EMBODIMENT

Figure 1:
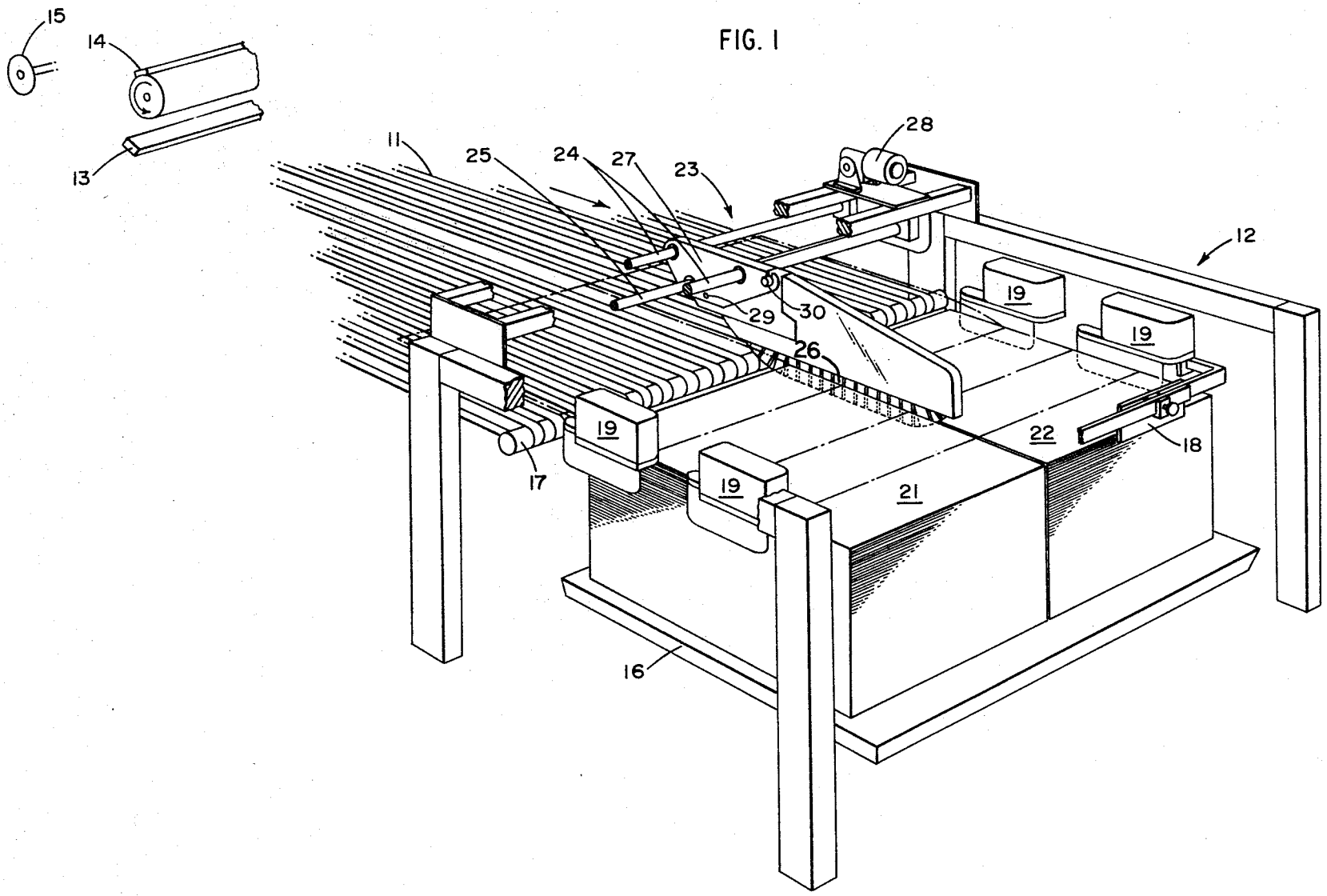
FIG. 1 is a perspective view of the layboy end of a sheeter piler system with the invention shown for forming two piles of sheets.

FIG. 1 is a perspective view of the delivery end of a high-speed sheeter in which a tape bed 11 transports cut sheets at high speed in the direction of the arrow for delivery to a layboy assembly 12. The sheets are derived in well known manner by unwinding a continuous web of paper one or more thicknesses of which continually pass over a bed knife 13 to be transversely cut by a rotating blade 14. The rate of rotation of the blade 14 and the linear speed of the paper past the bed knife 13 determine the cut length of the sheets delivered to the tape delivery 11. In accordance with well known practice edge trimming of the sheets can be performed and in relation to the present invention the transverse width of the sheets is subdivided by continuously slitting the sheets in the longitudinal direction by rotating slitting whell 15. One or more such wheels can be positioned anywhere across the transverse width of the oncoming web to produce any desired number of subdivisions in the width of the web and a corresponding number of separate sheets delivered to the piles in the layboy, as is well known in the art.

FIG. 1 shows a layboy arrangement having the conventional support platform 16 and a delivery roll 17 which projects the sheets delivered on the tapes at high speed into the layboy above the tops of the paper piles formed therein by a succession of such sheets previously delivered. An end stop 18 is ordinarily present and the support platform 16 is generally on an elevator automatically controlled such that the top of the forming pile is just below the level of delivery of sheets from delivery roll 17, all as is well known in the art. Also shown in FIG. 1 are improved active surface jogger mechanisms 19 which are of the type disclosed and claimed in applicants' referenced copending application. The jogger mechanisms 19 provide an endless belt moving in the direction of travel of sheets arriving in the layboy and a transverse component of the moving belts applies transverse jogging forces to the outside edges of the paper being piled in the layboy. In the showing in FIG. 1, since the slitter 15 has subdivided the web into two equal width streams of oncoming sheets the layboy contains two edge adjacent piles 21 and 22 of stacked sheets. The surface of the stacks 21 and 22 normally is in the form of the leading edge of the overlapped arriving sheets. The inertial, windage and frictional forces are such as to prevent delivery uniformly to the backstop 18 and such delivery may be aided by paddling into back edge alignment by a paddler, not shown.

In accordance with the present invention the plural piles 21 and 22 are formed with improved edge alignment with the introduction of a center guide assembly generally indicated at 23. The center guide assembly 23 is supported for transverse sliding movement on a pair of transverse support rods 24 and receives drive power by being engaged with a transverse drive rod 25 which passes through a support end 27 of the assembly. An electric motor and transmission assembly 28 is coupled to rotatably drive shaft 25 at a selected speed within a range of speeds of rotation. Knurled knob shouldered screws 30 and a pin 29 removably mount the driven assembly on the support end 27 as hereinafter described.

The assembly 23 is supported on the transverse guide rods 24 to project downstream therefrom as indicated aligned generally with the point of edge adjacency between the paper piles 21 and 22. Extending from the assembly 23 and projecting down between the upper portions of the piles 21 and 22 are a series of overlapping leaves 26 which move in the direction of sheet travel as the sheets arrive to be piled on the piles 21 and 22.

Figure 2:
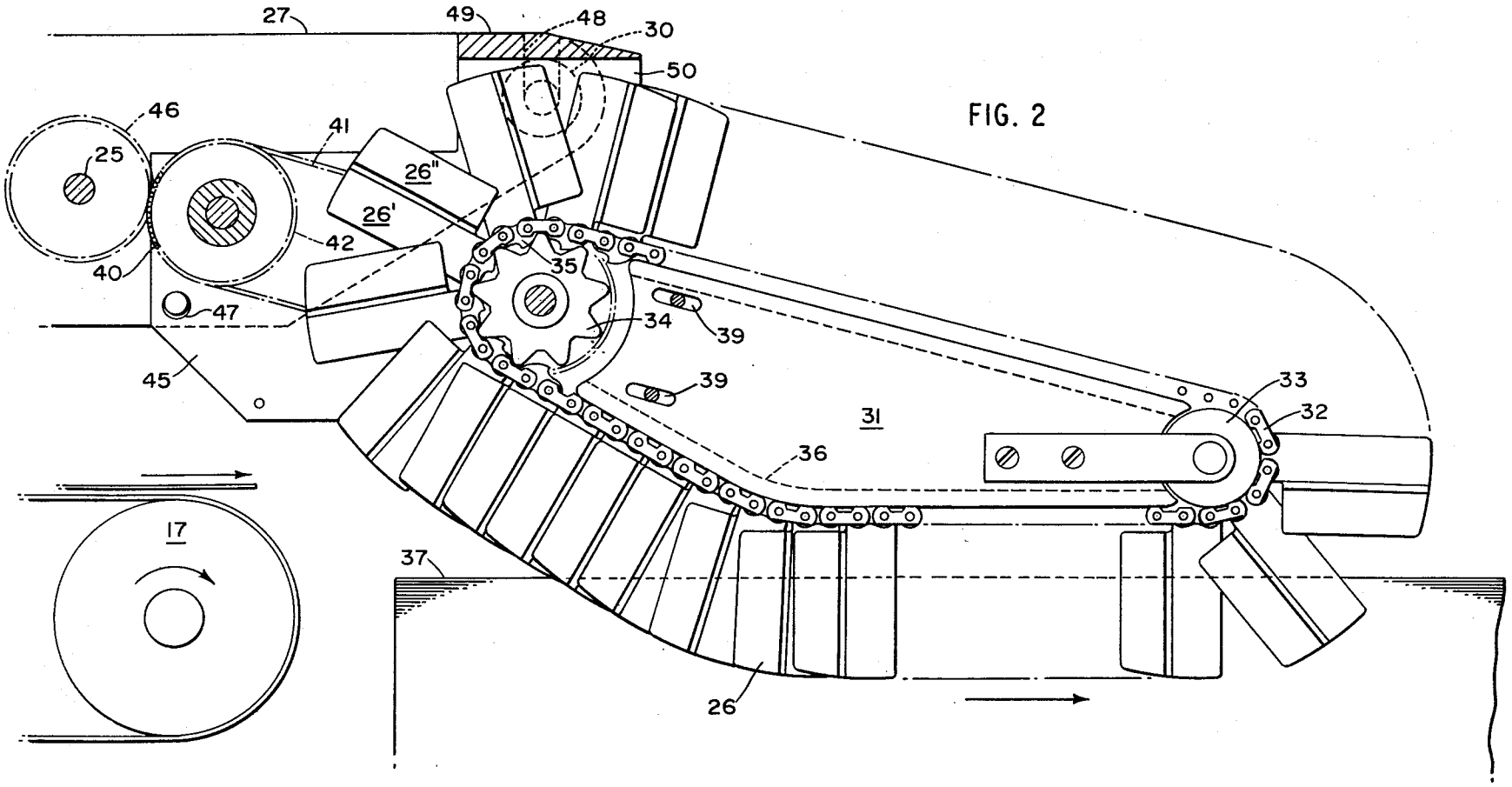
FIG. 2 is a side elevation of the center guide mechanism with a support plate removed to show details of construction.

Referring now to FIG. 2 further details of the center guide assembly will be described. The mechanism shown in FIG. 2 will be recognized as in part bearing a close resemblance to a power driven chain saw. Thus a chain guide bar 31 in the form of a flat plate having a predetermined peripheral outline for the desired path of travel of a chain 32 supports at opposite end thereof an idler pulley 33 and a drive sprocket 34. The guide bar 31 has a peripheral groove 43, (shown in FIG. 3), therein in which move drive links 35 which project inwardly from each chain link. These same drive links are engaged by the sprocket teeth of drive sprocket 34 which when driven imparts peripheral motion to the chain 32 around the periphery of the chain bar 31. In this regard, the mechanism will be recognized as similar to a power-driven chain saw as previously mentioned.

For the present invention the chain bar 31 which is in the form of a rigid flat plate having the features hereinbefore described preferably has the outline such that the chain traverses a continuous path corresponding generally to the periphery of a triangle having a relatively large obtuse angle in the region 36. Adjacent links of the chain 32 support outwardly projecting leaves 26 which are divided into two portions. A relatively narrow portion 26' projects from the attachment to the pivot pins of the corresponding link of the chain from which it projects and in the trailing direction relative to the motion of the chain the leaves 26 expand and become bifurcated at a portion 26'' such that adjacent leaves 26 can form a fully nesting position between the portions 26' of one leaf and the portion 26'' of an adjacent leaf in the regions where the chain is moving on a straight line path. As indicated in FIG. 2 the proportions of the leaf portions 26' and 26'' and the path around chain bar 31 are such that a partial overlap is maintained between adjacent leaves 26 even when the chain is passing over a curved portion of its path. Thus misalignment as the leaves move into nested engagement is avoided. It will also be noted from FIG. 2 that the obtuse angle 36 permits a gradual entry of the nested leaves 26 into a position between the oncoming sheets which arrive from delivery roll 17 at a level somewhat above the top of the pile indicated at 37 in FIG. 2. The projecting length of the leaves 26 is long enough and the mechanism is positioned such that the leaves project a considerable distance below the level 37 at which the pile is maintained by automatic elevator control as the pile builds. The vertical height of the leaves 26 at the pile and the downwardly progressing run as the leaves enter the position between adjacent piles is such that a control surface is presented to the adjacent edges of on-coming sheets during their time of arrival and throughout the period when the outer edge jogging forces are effective to correct edge alignment as the sheet descends from the top of the pile down into the completed portion of the pile which is stabilized by the weight of the over-burdened sheets.

Figure 3:
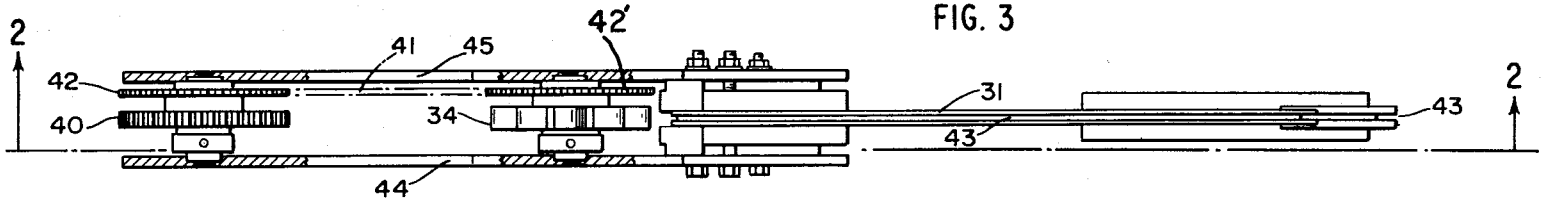
FIG. 3 is a top plan view of the apparatus shown in FIG. 2 with lines 2—2 in FIG. 3 generally indicating the view shown in FIG. 2.

Referring to FIG. 3, further details of the mechanism will be described. In FIG. 3 the chain and projecting leaves 26 are not shown. To drive the chain and leaf assembly the drive sprocket 34 is mounted for rotation on a shaft to rotate with a driven timing sprocket 42' driven by means of a timing chain 41 and a timing sprocket 42. The timing sprocket 42 rotates on a shaft with drive gear 40 which engages a driving gear 46 mounted on transverse drive shaft 25 which passes therethrough. The driving gear 46 is slidable along drive shaft 25 and thus irrespective of the transverse position of the assembly on the drive shaft 25 the sprocket 34 and thus the chain 32 can be driven at the desired speed of rotation determined by the speed of drive shaft 25.

The chain bar 31 is shown in FIG. 3 with peripheral groove 43 which serves as a guide for the chain. Drive sprocket 34 is rotatably mounted between frame plates 44, 45, which project out to be bolted through a region of chain bar 31 which is beyond the depth of the guide groove 43 and thus supports the chain bar 31 without interferring with the travel of the chain or the projecting overlapping leaves. Similarly, interference with the travel of the leaves between plates 44 and 45 is avoided by spacing timing sprocket 42 such that its periphery is far enough from the drive sprocket 34 to permit passage of the projecting leaves through the space between plates 44 and 45. By analogy to the chain saw structure, any suitable arrangements for movably adjusting the position of chain bar 31 relative to sprocket wheel 34 to permit the chain to be placed thereon can be provided as, for example, by slotted holes 39 for the bolt connections between the support plates 44, 45 and the chain bar 31. Any such well known arrangement for mounting and demounting the chain and tensioning the chain for proper operation can be employed and such arrangements are well known in the art.

Referring to FIGS. 1 and 2 the removable mounting off the center guide assembly portion shown in FIG. 2 in the center guide assembly 23 of FIG. 1 will be described. The support end 27 is slidably on support rods 24 and rotatably supports drive gear 46 which is slidable on and driven by drive shaft 25. Frame plates 44, 45 have aligned holes 47 positioned to be aligned with holes in support end 27 and receive pin 29 therein when the gears 40, 46 are engaged. For further support of the assembly of FIG. 2 the support end 27 has on each side upwardly open slots 48. A yoke 49 bridges the frame plates 44, 45 and is slotted at 50 to permit passage of the leaves 26. Threaded into the sides of yoke 49 are the shouldered screws 30 which pass through the slots on either side of support end 27. By loosening the knurled screws 30 and removing the pin 29 the portion of the assembly shown in FIG. 2 can be readily removed from support end 27 with gears 40, 46 disengaging as the unit is removed. Conversely, placing the unit in position such that pin 29 can be inserted by aligning holes in support end 27 and holes 47 in plates 44, 45 permits gears 40, 46 to be engaged and the position is secured by tightening knurled knobs 30.

Figure 4:
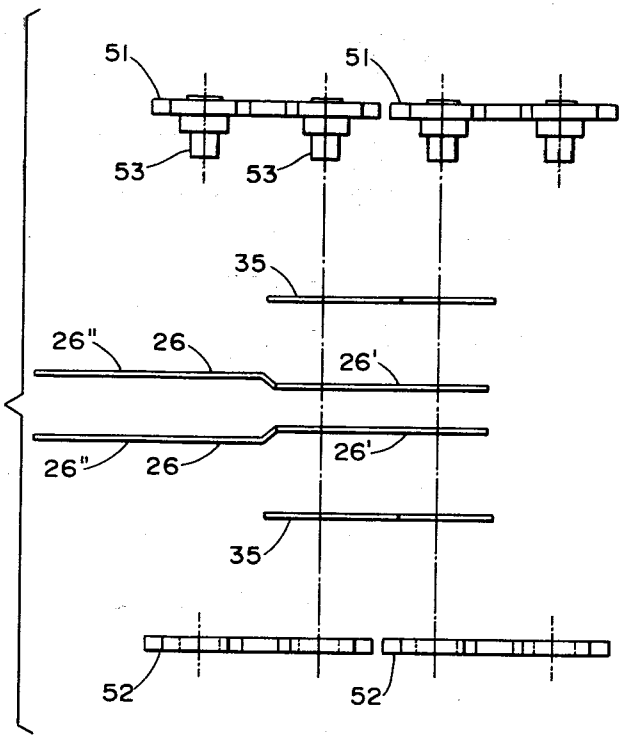
FIG. 4 is an exploded view of one bifurcated plate and its arrangement for mounting on the drive chain.

Referring now to FIG. 4 an exploded view of the chain and leaf assembly is shown. The chain comprises a set of outside tie straps 51 and 52 in the form of individual links. The links 51 have projecting therefrom pivot pins 53 which project through corresponding holes in the links 52 and are secured by C rings or the like. Bridging adjacent tie straps 51 and 52 on each side are drive links 35 previously described with projections which are engaged by the teeth of sprocket gear 34. Between the drive links 35 leaves 26 are positioned and as shown the leaves 26 comprise right hand and left hand members bent to project in opposite directions to form the bifurcated spaced portions 26''. The portions 26' when assembled are in face adjacency such that the spacing between the bifuracted portions 26'' is the sum of the right and left hand offset shown in FIG. 4. The portions 26' are drilled or stamped to receive the pins 53 and be supported thereby when the chain with projecting leaves is assembled. The material of the leaves 26 is preferably fabricated from a spring steel such as AISI 1075 through 1095 of thickness approximately 0.022 inches. In the device shown the leaves are approximately 3 inches wide and 5 and inches long and the offset is positioned approximately midway so that the portions 26' and 26'' are approximately of equal size. The end of the leaves remote from the chain support may be arcuate in shape to accommodate the pasage of the leaves around the circular portions of the path which they travel.

Figure 5:
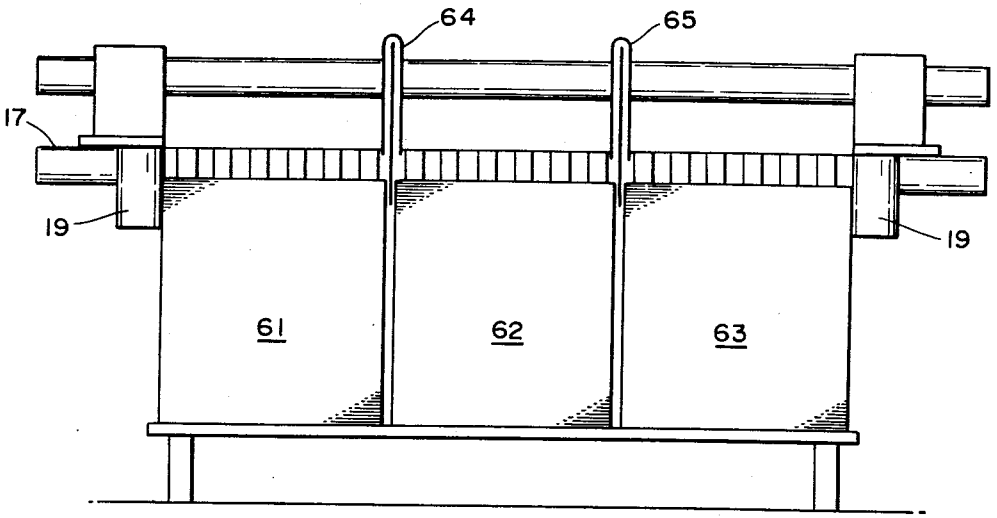
FIG. 5 is an end view of a three pile layboy.

FIG. 5 is an end view of a layboy in which three piles of paper are being formed simultaneously. The three piles 61, 62 and 63 are maintained in alignment utilizing outboard jogger mechanisms 19 as hereinbefore described with the edge adjacent surfaces and sheets of the piles separated by respective center guide mechanisms 64 and 65. Each of the center guides 64 and 65 is a mechanism of the type shown in detail in FIGS. 2 and 3 as herein described. Other arrangements of plural piles formed simultaneously are possible using the present invention since the center guides such as 23 can be positioned asymmetrically with respect to the width of the pile in forming two piles of unequal width sheets and as shown in FIG. 5 more than two piles can be formed. It is also possible in the FIG. 5 arrangement to position the center guides 64 and 65 such that unequal width piles are formed.

The operation of the invention is considered to be self-evident from the foregoing description thereof and various modifications will occur to those skilled in the art and such modifications are considered to be within the scope of the invention as defined in the appended claims.

We claim:

1. The method of forming a plurality of adjacent even edged piles of flexible sheets simultaneously delivered in a generally horizontal direction to the top surface of said piles comprising the steps of:

delivering sheets the size of said piles in side by side adjacency to the tops of said piles;

confining the outside lateral edges of sheets delivered to said piles by contact with active surface area constraints spaced nominally the sum of the widths of said sheets;

moving said active surface area constraints continuously in the direction of travel of the delivered sheets while providing incremental oscillatory variation of the spacing between said surface area constrains on said outside opposite lateral edges by reciprocating said active surface areas substantially normal to said direction of travel to make contact with said lateral edges along extended portions thereof during each reciprocation;

confining the inside adjacent edges of sheets delivered to said piles with a thin surface area constraint positioned between said adjacent edges; and moving said thin surface area constraint continuously in the direction of travel of the delivered sheets.

2. In a layboy for receiving and piling a plurality of side-by-side delivered sheets into a like plurality of side-by-side piles including a platform for supporting said piles, the improvement comprising:

jogger means supported at the tops of said piles on opposite sides of said layboy and spaced to make jogging contact with the outside edges of sheets delivered in inner edge adjacency to said layboy;

thin elongated separator means supported between the adjacent inner edges of said delivered sheets at the tops of said piles, said separator means providing substantial opposed contact areas for opposed edges of adjacent sheets and extending along the inner edges of said piles for reacting the transverse jogger forces applied to said outside edges by said jogger means; and means for moving said separator means continuously in the direction of travel of sheets delivered to said piles.

3. Apparatus according to claim 2 wherein at least three piles are formed by simultaneous side-by-side delivery of a plurality of sheets corresponding to the plurality of piles and a plurality of said separator means are provided one between each pair of edge adjacent sheets and piles.

4. Apparatus according to claim 2 wherein said separator means comprises:

a flat rigid plate the edge of which defines a smooth peripheral path;

an endless flexible member supported and guided on said edge and movable along said peripheral path;

a set of overlapping leaves supported on said endless member to project outwardly from said edge approximately in the plane of said rigid plate;

means for supporting said plate such that said leaves project between adjacent inner edges of said delivered sheets; and means for driving said endless member around said peripheral path to move said overlapping leaves between adjacent inner edges of said sheets and in the direction of travel of said sheets.

5. Apparatus according to claim 4 wherein said rigid plate is shaped to provide a path for said endless member generally in the shape of a triangle with a large obtuse angle, said means for supporting and means for driving being arranged such that said leaves move downwardly around said obtuse angle to enter between said adjacent inner edges and move beyond said obtuse angle in said direction of travel.

6. A center piler guide for use in guiding adjacent edges of piles of sheets formed by side-by-side delivery of edge adjacent sheets to the tops of said piles comprising:

a flat rigid plate the edge of which defines a smooth peripheral path;

an endless flexible member supported and guided on said edge and movable along said peripheral path;

a set of overlapping leaves supported on said endless member to project outwardly from said edge approximately in the plane of said rigid plate;

means for driving said endless member and said overlapping leaves carried thereby around said peripheral path; and means for supporting said rigid plate without interferring with the movement of said overlapping leaves.

7. Apparatus according to claim 6 wherein said rigid plate is a chain bar and said flexible endless member is a link chain with drive links projecting inwardly to guide and drive said chain on the edge of said chain bar and said overlapping leaves are supported on the connecting links of said chain.

8. Apparatus according to claim 7 wherein said overlapping leaves have bifurcated trailing portions extending toward the next following leaf and spaced to receive the portion of the next following leaf which projects outwardly from its support connection on said chain, said portions being proportioned to achieve an approximately fully nested relation between respective portins of adjacent leaves when said chain moves on a straight line segment of said path.

9. Apparatus according to claim 8 wherein said portions and the curved segments of said path are proportioned to maintain at least a partial overlap between adjacent leaves when said chain moves on a curved segment of said path.

10. Apparatus according to claim 9 wherein said chain bar has an outline generally in the shape of a triangle with a large obtuse angle the support for said chain bar positioning one of the shorter sides approximately horizontal to project said leaves downwardly between said piles, the other shorter side extending above said piles in the direction of arriving sheets such that the entry of said leaves between oncoming sheets occurs as said leaves pass over said obtuse angle.

11. Apparatus according to claim 6 and including a support end member adapted to be mounted above the point of delivery of said sheets; and wherein said means for supporting said rigid plate includes a removable connection to said support end member.

12. Apparatus according to claim 11 wherein said support end member includes a rotatable drive means which engages and drives said means for driving said endless member when said means for supporting is connected to said support end member.

* * * * *